US005502276A

United States Patent [19]

Jameson

[11] Patent Number: 5,502,276

[45] Date of Patent: Mar. 26, 1996

[54] ELECTRONIC MUSICAL KEYBOARD INSTRUMENTS COMPRISING AN IMMOVABLE POINTING STICK

[75] Inventor: David H. Jameson, Chappaqua, N.Y.

[73] Assignee: International Business Machines Corporation, Armonk, N.Y.

[21] Appl. No.: 432,656

[22] Filed: May 2, 1995

Related U.S. Application Data

[63] Continuation-in-part of Ser. No. 215,345, Mar. 21, 1994.

[51] Int. Cl.[6] ..... G10H 7/00

[52] U.S. Cl. ..... 84/645; 84/743

[58] Field of Search ..... 84/600, 644, 670, 84/671, 645, 658, 743

[56] References Cited

U.S. PATENT DOCUMENTS 4,932,304 6/1990 Franzmann ..... 84/671
5,231,386 7/1993 Brandenburg et al. .
5,247,131 9/1993 Okamoto et al. ..... 84/661
5,265,516 11/1993 Usa et al. ..... 84/600
5,269,004 12/1993 Comerford et al. .
5,278,350 1/1994 Okamoto et al. ..... 84/661
5,278,557 1/1994 Stokes et al. .
5,287,089 2/1994 Parsons .

*Primary Examiner*—William M. Shoop, Jr.
*Assistant Examiner*—Jeffrey W. Donels
*Attorney, Agent, or Firm*—Stephen C. Kaufman

[57] ABSTRACT

A performance controller for supporting multiple parameter control. The controller comprises means for equipping an electronic musical instrument with at least one pointing stick, the or each pointing stick dedicated to a preselected information parameter and being adapted for sensing a force indicative of a desired control parameter; and, means for translating said force into a corresponding musical instrument digital interface instruction.

6 Claims, 5 Drawing Sheets

FIG. 5c
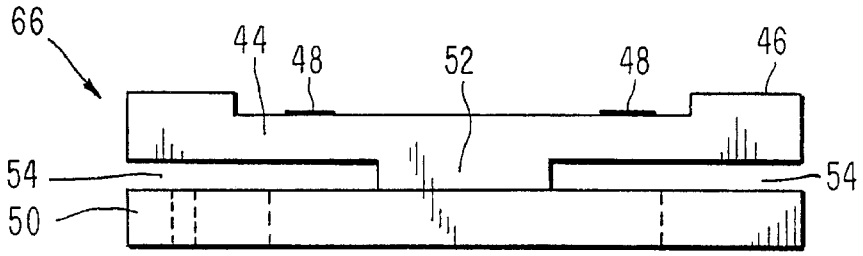
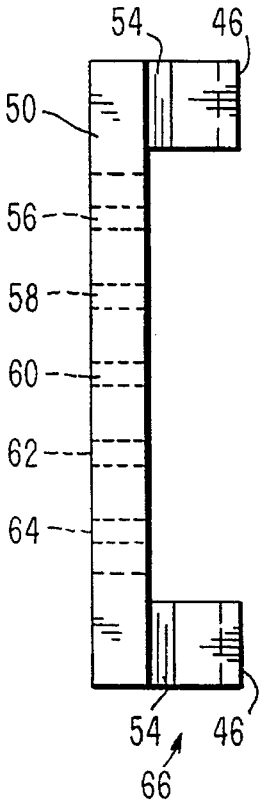
FIG.5b
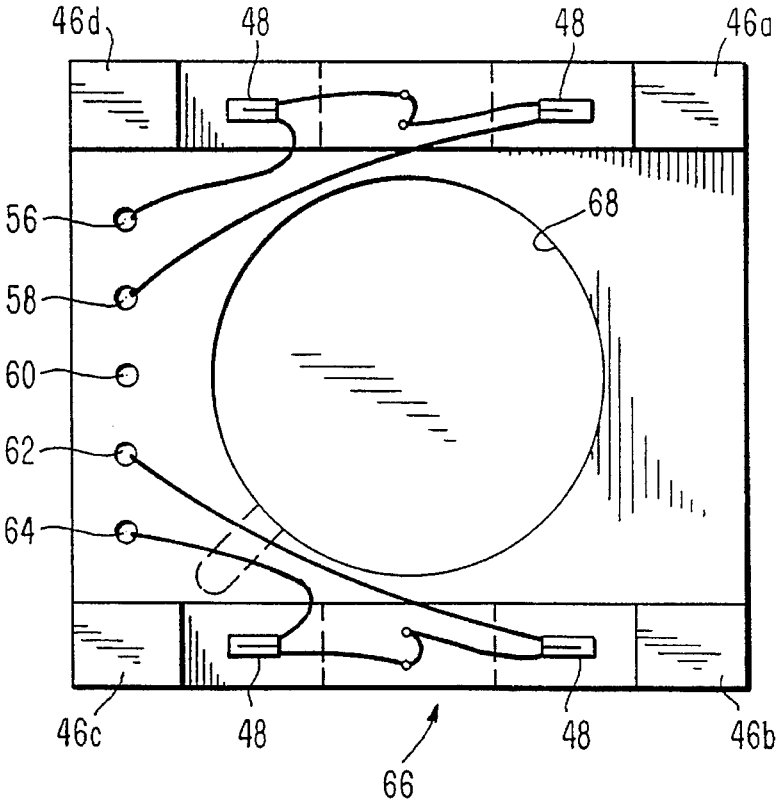
FIG.5a

ELECTRONIC MUSICAL KEYBOARD INSTRUMENTS COMPRISING AN IMMOVABLE POINTING STICK

CROSS-REFERENCE TO RELATED APPLICATION

This application is a continuation-in-part of a copending and commonly assigned patent application Ser. No. 08/215,345 filed Mar. 21, 1994. The entire disclosure of this application is incorporated by reference herein.

FIELD OF THE INVENTION

This invention relates to electronic musical keyboard instruments.

INTRODUCTION TO THE INVENTION

FIG. 1 shows a canonic electronic musical keyboard instrument 10. In overview, the instrument 10 comprises a set of subsystems linked together by a microprocessor 12.

One subsystem for a typical instrument (such as a synthesizer or sampler) may comprise performance information controllers 14, for example, a keyboard 16, a plurality of wheels 18, or levers, joysticks or pedals (not shown).

Another typical subsystem may include voice circuitry 20 comprising memory 22 for storing preset sound programs, and front panel controls 24 for such instrument specific tasks as programming the sounds and setting operation modes.

SUMMARY OF THE INVENTION

We have observed that sophisticated electronic musical keyboard instruments, of the type shown in FIG. 1, may support a large number of performance information parameters that preferably are controlled in real-time. Examples of such performance information parameters may include pitch bending, volume changes, vibrato (depth and rate), panning or timbre modulation.

To an end of interfacing and transforming a human input of a desired performance information parameter for ultimate musical realization, it is known to utilize performance controllers of the type referenced above with respect to FIG. 1, namely, wheels, levers, joysticks or pedals. For example, most keyboard controllers typically include a couple of wheels, one of which is normally used as a pitch bender, and the other as an assignable controller for one other information parameter. Alternatively, some keyboards employ a joystick, and combine into one device a pitch bend and an assignable controller. All in all, however, we have discerned that most people prefer the wheels.

FIG. 2 shows a typical wheel 26. A person can revolve the wheel in a forward or backward direction, as shown by the arrow, while depressing a key of an electronic instrument. The wheel 26 is mounted on a rotation shaft 28 of a potentiometer 30 and with a return spring 32. In response to a revolution angle of the wheel 26, a tone pitch of a musical tone to be generated, may, for example, be raised or lowered from a reference tone pitch of the depressed key.

We have critically analyzed the performance attributes of various performance controllers, with special attention to wheels and joysticks, and have determined that these controllers may be less than optimal.

For example, wheels poise at least a four-fold problem. First of all, they take up a lot of space. Second, they are clumsy to work with, since it is necessary to be able to grab the wheel with both a thumb and a finger. Third, only one information parameter can be assigned to a wheel. Thus, even if a keyboard supports many wheels, it is impractical to control several of them simultaneously. Fourth, a desired sensitivity of touch in accordance with applied pressure, is usually delimited due to the action of the wheel and the mechanical action of the return spring.

Of related interest is U.S. Pat. No. 4,932,304 to Franzmann.

Franzmann discloses control devices for the manual playing of electronic musical instruments having a main key system and an additional control device for simultaneous playing actions with one hand of the player. To this end, Franzmann discloses a control handle (see e.g., columns 3, 4, 5, 9 and FIGS. 3, 4, 5 and 6) that is movable in one or more planes or directions (±x,y,z movement), with respect to the instrument. Musical control can only be effected by way of a substantial mechanical displacement of the control handle variously in the x, y, z directions.

I have now discovered a novel process and apparatus that addresses and obviates these problems, thereby providing important advantages, as indicated below.

In one aspect, the present invention discloses a process for retrofitting an electronic musical instrument for supporting multiple parameter control, the process comprising the steps of:

(1) equipping the electronic musical instrument with at least one pointing stick, the or each pointing stick dedicated to a preselected information parameter and being adapted for sensing a force indicative of a desired control parameter; wherein the or each pointing stick is substantially immovable with respect to the instrument but can respond to finger-tip-inputs;

and (2) connecting the or each immovable pointing stick to a musical instrument digital interface (MIDI) generator means for translating a force into a corresponding musical instrument digital interface instruction.

In a second aspect, the present invention discloses a retrofitted electronic musical instrument suitable for supporting multiple parameter control, the instrument comprising:

(1) at least one pointing stick, the or each pointing stick dedicated to a preselected information parameter and being adapted for sensing a force indicative of a desired control parameter; wherein the or each pointing stick is immovable with respect to the instrument but can respond to finger-tip inputs;

and (2) a musical instrument digital interface (MIDI) generator means for translating said force into a corresponding musical instrument digital interface instruction.

The present invention can yield important advantages.

One advantage may be realized as a consequence of the fact that the present invention requires a pointing stick, whose utilization can obviate the need for a conventional wheel or joystick. The pointing stick can obviate many of the deficiencies of the conventional wheel, while retaining and enhancing all the virtues of sensitivity important for expressive musical performance.

The pointing stick is smaller than the wheel (or joystick), and a plurality of such elements may be incorporated in a keyboard instrument in favor of one larger wheel. The pointing stick need not move with respect to the instrument itself, and several of them can be used together, perhaps even one for each finger tip. This capability is to be sharply contrasted with the wheel, which requires at least a thumb and a finger for evolvement of the mechanical spring.

Other advantages of the present invention include its great versatility, in the sense that it can be used to excellent effect on controllers other than keyboards, including e.g., a MIDI guitar controller or MIDI wind controller, and its efficient implementation, as specified in detail, below.

BRIEF DESCRIPTION OF THE DRAWING

The invention is illustrated in the accompanying drawing, in which

FIGS. 5*a*–5*d* shows details of a pointing stick; and

DETAILED DESCRIPTION OF THE INVENTION

Figure 2:
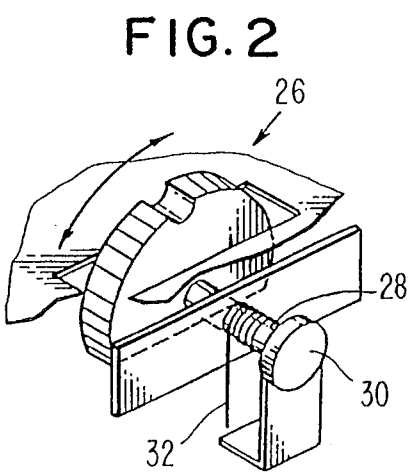
FIG. 2 shows a performance controller comprising a mechanical wheel.
Figure 1:
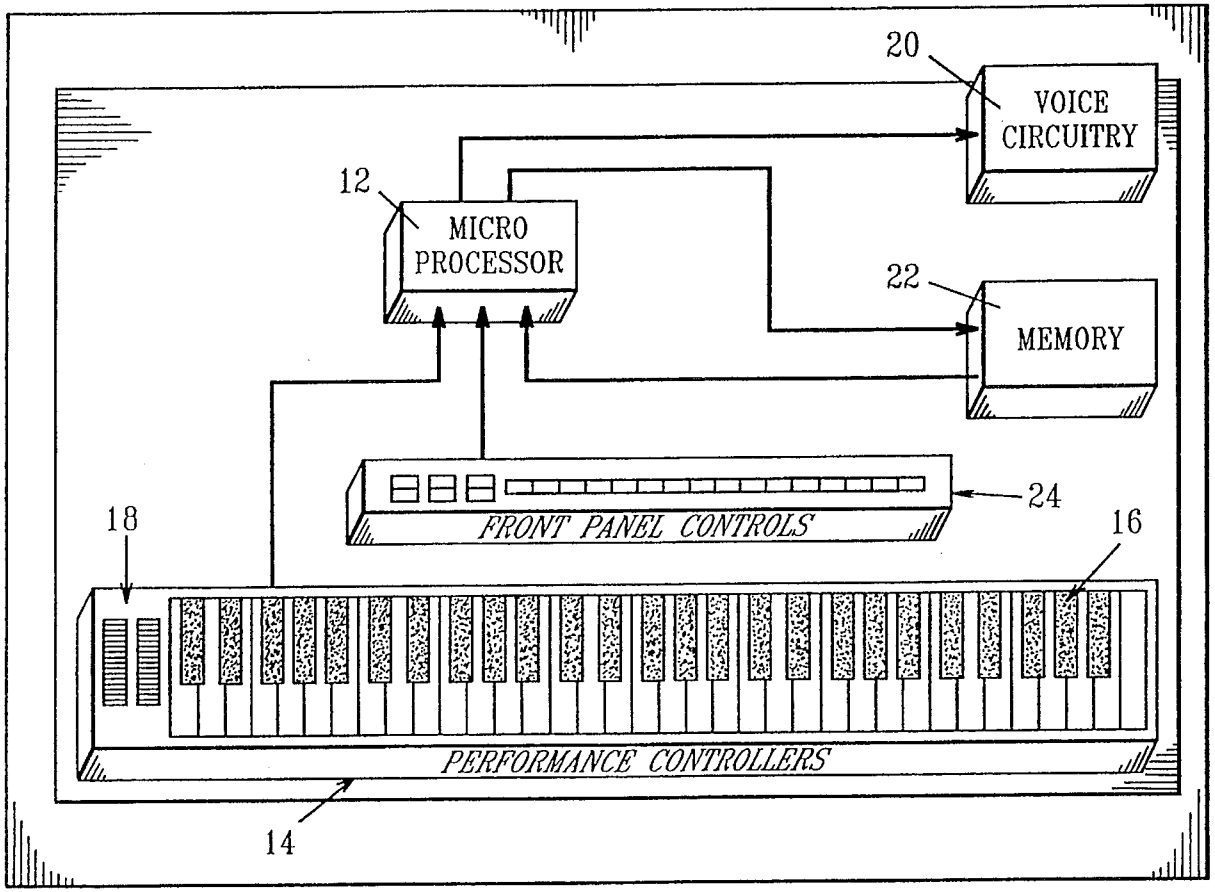
FIG. 1 shows a canonic electronic musical keyboard instrument.
Figure 3:
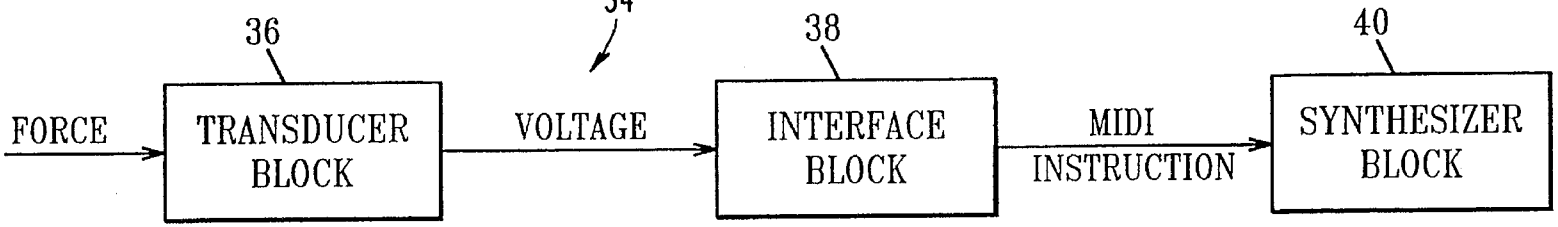
FIG. 3 shows a block diagram overview of the present invention.

Attention is now directed to FIG. 3, which shows a block diagram 34 overview of the present invention. Generally, the block diagram 34 comprises a transducer block. 36 connected to an interface block 38, in turn connected to a conventional synthesizer block 40. In particular, the transducer block 36 comprises a pointing stick which can convert a force supplied by a musical performer into a voltage equivalent. The interface block 38 comprises software which can accept the voltage inputs (e.g., voltage bits), and scale the voltages, thereby generating a MIDI (Musical Instrument Digital Interface) instruction for input to the synthesizer block 40. We now specify details on each of these FIG. 3 blocks.

The Pointing Stick

As just indicated, the pointing stick can convert a force supplied by a musical performer, into a voltage equivalent. A pointing stick may be dedicated to any one of a plethora of preselected performance information parameters, including e.g., pitch bending, volume changes, vibrato (depth and rate), panning or timbre modulation etc.

Figure 4:
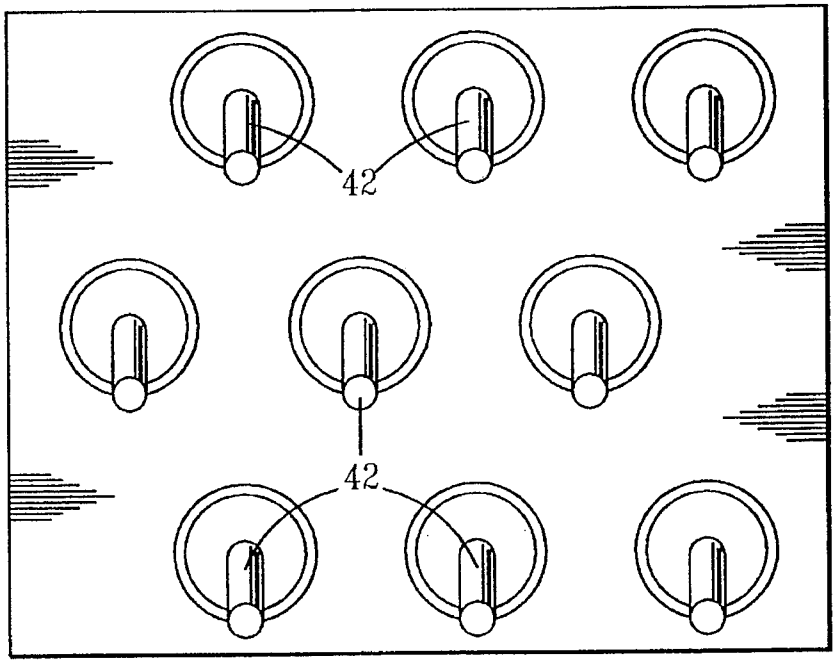
FIG. 4 shows a pointing stick that may be used in the present invention.

For our purposes, a suitable such pointing stick is disclosed in a paper entitled Force-to-Motion Functions for Pointing by J. R. Rutledge et al, Human-Computer Interaction, pg. 701–706, North-HollandAmsterdam, August 1990, and incorporated by reference herein. FIG. 4 shows an array of such a pointing stick 42.

The FIG. 4 pointing stick 42 may be thought of as a miniature isometric joystick, preferably located on a musical keyboard instrument near extant wheels, or as a replacement thereof. Alternatively, the pointing stick 42 may be positioned on an independent structure, and linked to the musical keyboard instrument by way of a cable.

The pointing stick 42 preferably comprises a steel rod, preferably of approximately 2 mm diameter and 2 cm length, and preferably mounted on an acrylic base. A section near the base preferably has orthogonal flats to which miniature semiconductor strain gauges may be bonded.

The base preferably is glued on the surface of a musical keyboard instrument, so that the pointing stick 42 protrudes approximately 4 mm above the surface of the instrument. A top of the pointing stick 42 preferably is rounded, to provide a compatible fingertip grip.

The pointing stick 42 may comprise a cantilever structure, of the type shown in FIGS. 5*a* through 5*d*.

FIGS. 5*a* through 5*d* show a plan view, an end view, a side view and a perspective view, respectively, of a cantilever-type embodiment of the present invention.

In detail, FIG. 5 shows a cantilever armor beam 44, which can carry anvils (46 in FIG. 5*c* and 46*a*–46*d* in FIG. 5*a*) on their outer ends, and which may be bent by an applied force. A distinguishing feature of this embodiment is that the element 44, which can resist an applied force, is distinct from a sensor proper 48.

Strain gauge sensors will now be described as an example of the cantilever structure shown in FIGS. 5*a*–5*d*. A resulting strain in one or more surfaces of the beam 44 may be detected as a resulting change in a resistance of an attached strain gauge, by well-known techniques. Miniature semiconductor strain gauges are appropriate for this function.

Preferably, four sensors 48 are on the upper or lower surface of each beam, and can provide vertical forces; gauges similarly located on the sides of the beams 44 can provide axial torque, if required. Conventional techniques require at least two gauges, on opposite surfaces, with perhaps two more oriented across the direction of strain, for precision measurement, temperature compensation, etc. However for the present purposes, especially if only a horizontal component of an applied force is required to be measured, one on each beam suffices; since the four gauges so used are in similar temperature environments, they can be made to be mutually compensating. If the vertical and torque forces are required, more gauges may be required for high accuracy and/or temperature compensation. The resistances may be measured and the resulting signals completely or partially processed by integrated circuitry located on a chip, or by circuitry located at a distance, and connected by an appropriate cable, which can be small enough to fit into the free space in most current keyboards.

In FIGS. 5*a*–5*d*, a reference numeral 50 refers to a rigid base of the cantilever assembly. Reference numeral 52 refers to a rigid part of the base which does not appreciably move. The part 52 simply connects the cantilever arm 44 to the base 50. The parts 44, 50 and 52 are all one piece. Reference number 54 represents a gap that exists between the cantilever arm 44 and the base 50. Reference numerals 56–64 show terminal points which are holes for receiving the necessary wiring used to relate information from the strain gauge to the outside of the sensor chip. Reference numeral 66 refers, in general, to the cantilever-type embodiment.

Figure 5D:
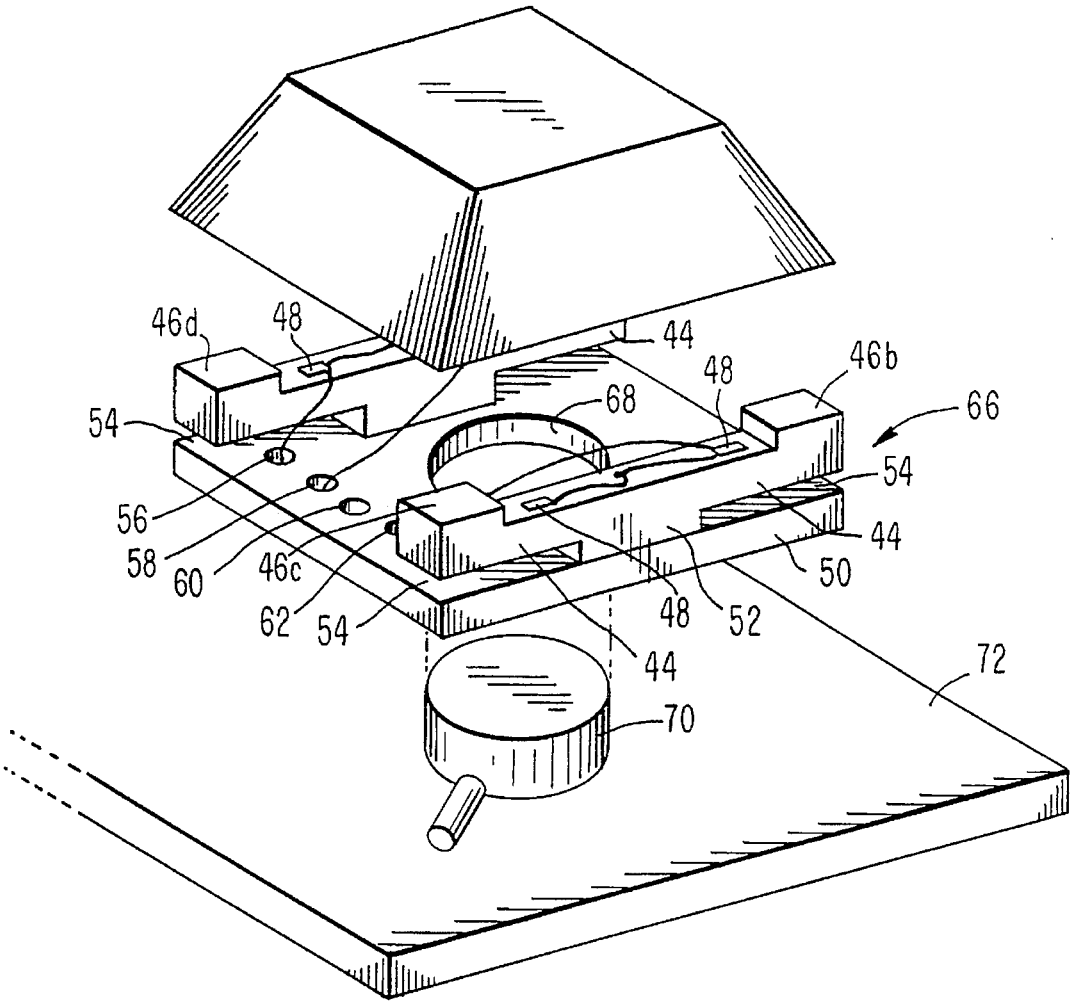

In FIG. 5*a*, a reference number 68 refers to a section of the base 50 which is hollowed out so as to be able to accommodate a conventional lower part 70 of a key-mechanism of a keyboard base 72, as shows in FIG. 5*d*.

The above-described cantilever-type embodiment may use other types of sensors besides strain gauge sensors. The following is a list of other types of sensors which may be used as an alternative to the strain gauge sensors described above.

a. Piezo-electric sensors: A strip of piezo-electric material may be bonded to one or more surfaces of each beam, as in the strain gauge case. Bending of the beam can result in both bending and strain in the piezo-electric material, with resultant displacement of charge. This action may be detected either as a voltage or directly by an operational amplifier in an integrator mode, the resulting signal providing a required force measurement.

b. Magnetic reluctance sensors: A magnetic flux circuit runs through the cantilever arm 44, the gap 54 between the anvil end of the arm and the base 50, the base 50, and the anchorage 52 of the arm. Flux may be supplied by a permanent magnet located in any part of this circuit (except the gap).

All of these parts preferably comprise a material with high magnetic permeability, such as permalloy. Movement of the arm 44 can result in a change in the gap, with a resultant change in the flux in the circuit; this change results in a voltage in a coil surrounding some part of the circuit remote from the permanent magnet. This is input to an integrating operational amplifier, or circuit with similar function, the output of which can give a measure of the position of the anvil, and hence of the force on it. This is similar in principle to the familiar variable reluctance phonograph pickup.

c. Variable inductance sensors: A coil may be located in the base 50 immediately below the end of cantilever arm 44 carrying the anvil 46, and the bottom of that arm carries a high-permeability 'core' which may be inserted into and withdrawn from the coil as the arm moves up and down. A resulting variation in the inductance of the coil from its value in the 'zero' position of the arm may be detected by any of the well-known circuits for this purpose.

d. Variable capacitance sensors: One plate of a capacitor is located on the base 50 under the end of the cantilever arm 44 carrying the anvil 46, and the other is located on the lower surface of that arm. The capacitance varies with the position of the arm, and its deviation from the 'zero' condition may be measured by any of the well-known methods. Due to the small size of the capacitance in question and the magnitude of stray effects, it is desirable to locate the first stage of the required circuitry on a chip, in proximity to the sensor.

The Interface Block

As summarized above, the positioning stick just described can convert a force supplied by a musical performer, into a voltage equivalent. The FIG. 3 interface block 38, in turn, functions to accept these voltage inputs (e.g., voltage bits) and scale the voltages, thereby generating a MIDI instruction for input to the conventional synthesizer block 40.

A force may be converted into a voltage equivalent of a (graduated-scale) MIDI command. For example, a pitch-bend scale may range from −8000 to +8000, while a corresponding voltage scale may range from −5 V to +5 V. Then, say, in a typical scaling, the voltage range may be divided into 256 subdivisions, so that one may convert a force/voltage into a MIDI (pitch-bend) equivalent.

Figure 6:
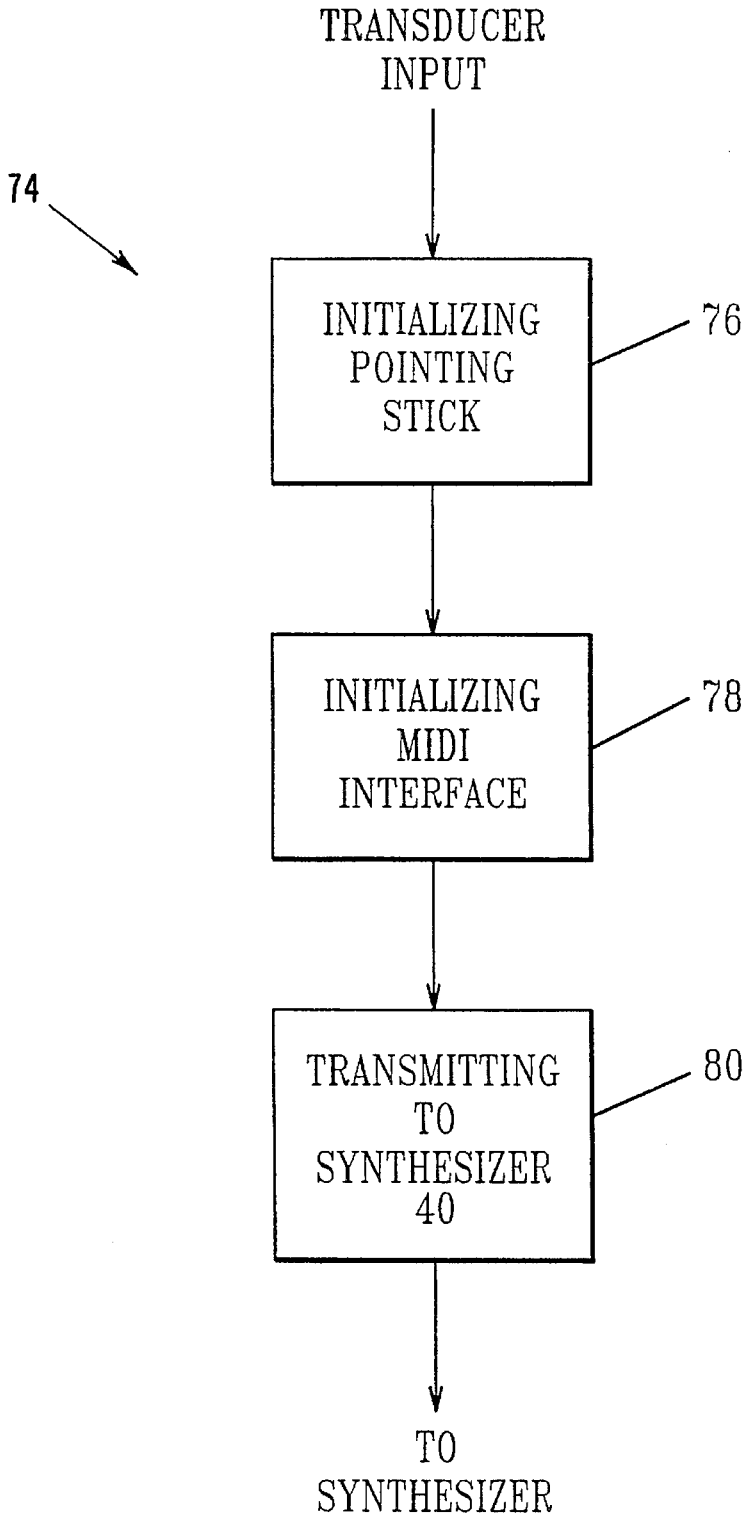
FIG. 6 provides a flowchart in realization of an element of the present invention.

FIG. 6 shows a flowchart 74 for suitable realization of this interface function. In overview, the flowchart 74 includes block 76 comprising initializing a pointing stick for directly reading a force; block 78 comprises initializing MIDI interface; and, block 80 comprises repeatably reading a force on the pointing stick, and sending and transmitting a MIDI instruction to the FIG. 3 synthesizer block 40.

Now appended is a program written in language C that may be used in effecting the FIG. 6 flowchart 74.

```
#include <dos.h>
#include <stdlib.h>
#include <time.h>
#include <sys\timeb.h>
#include <conio.h>
#include <ctype.h>
#include <stdio.h>
#include "stdtyp.hpp"

void kcom(byte command)
{
   outp(0x64,command);  //writes command
   while (((inp(0x64)) & 0x02) != 0x00)
      ;
}

byte WaitForByte()
{
   boolean done = false;
   byte b;
   while (!done)
      {
         while ( ((b = inp(0x64)) & 1) != 1)
            ;
         if ( (b & 0x21) == 0x21 )
            then done = true;
            else getch();
      }
   return inp(0x60);
}

byte Command(byte command)
{
   kcom(0xd4);
   boolean done = false;
```

```
   while (!done)
      if ( (inp(0x64) & 1) == 1)
         then getch();
         else done = true;
   outp(0x60, command);
   byte b;
   while ( ((b = inp(0x64)) & 2) != 0)
      ;
   return WaitForByte();
}

static long int ticks_per_ms;

long int measure_time()
{
   timeb timebuffer;
   long start,elapsed,l;

   ftime(&timebuffer);
   start=((timebuffer.time)*1000)+(timebuffer.millitm);
   for(l=0;l<200000;l++) {}
   ftime(&timebuffer);

elapsed=((timebuffer.time)*1000)+(timebuffer.millitm)-s
tart;
   ticks_per_ms=200000/elapsed;
   return(ticks_per_ms);
}

void delayms(long milliseconds)
{
   long int l;
   for (l=0;l<(milliseconds*ticks_per_ms);l++)
      ;
}
```

```
byte readcontstat()
{
   kcom(0x20);
   while ( ( (inp(0x64)) & 0x22) != 0x00 )
      ;
   return inp(0x60);
}

void writecontstat(byte statbyte)
{
   kcom(0x60);
   while ( ( (inp(0x64)) & 0x02) != 0x00 )
      ;
   outp(0x60,statbyte);
}


extern "C"
{
#include "drivers.h"
}

byte mport=0,noteon=0x90;
int
clkfrq,cport=1,ondur=2,quit=0,mchan=0,comp=7,MidatorClo
ck=0;
int model = 101;
int clkmin=392,clkmax=612;

inline void Send3Bytes(word8 status, word8 b1, word8 b2)
{
   sbmidi(mport, status);
   sbmidi(mport, b1);
   sbmidi(mport, b2);
}
```

```
const byte channel = 0;   // MIDI Channel 0
void PitchBend(int value)
{
   Send3Bytes(PITCH_BEND + channel, value & 0x7f, value
>> 7);
}

int Y(int x, int x1, int x2, int y1, int y2)
{
   return int(
      ( ( double(x-x1) * double(y2-y1) ) / double(x2 -
x1) ) + double(y1));
}


void StartMidiator(int minval, int maxval)
{
        model = 101;
        quit=0;
        idmidi(model);
        printf("\n\n MS-%d Selected - Searching COM Ports
 ",model);
        parmidi((byte)comp,1);
        cport=1;
        do {
                int n;
                onmidi();       /*power up MIDIator*/
                dlymidi(6);         /*wait for power to
stabilize*/
                tsmidi(255);    /*set tempo scale factor
to max*/
                clkfrq=0;
                dlymidi(1);           /*sync to system
clock*/
                stmidi();       /*start interrupts*/
```

```
                for (n=0;n<18;++n) {        /*sum clock
ticks for approx 1 second*/
                        dlymidi(1);
                        clkfrq+=timidi();
                }
                clmidi();       /*interrupts off*/
                if (clkfrq>clkmax || clkfrq<clkmin) {
/*see if MIDIator clock runs*/
                        printf("\n\n MIDIator not found
on COM%d!",cport);
                        cport+=1;
                        offmidi();
                        prtmidi(cport);   /*change port
- power MUST be off*/
                }
                else
                        break;
                if (cport>2) {    /*terminate program if
neither port*/
                        printf("\n\n MIDIator not found,
terminating!\n");
                        dlymidi(18);
                        exit(0xff);      /*return error
value to dos*/
                }
        } while (1);

        parmidi((byte)comp,MidatorClock);
        stmidi();
        printf("\n\nPointing    stick    performance
controller\n");
        printf("July 1993, Experimental\n");
        byte b, oldb;
        while (true)
            {
```

```
                Command(0xe2);
                Command(0x3d);      // 0x3E gets Y axis

                byte b = WaitForByte();
                if (b != oldb)
                   then
                      {
                                        int    output    =
Y(b,0,255,minval,maxval);
                         PitchBend( output );
                         oldb = b;
                      }
             }
          offmidi();
          dlymidi(18);
}


void main(int argc, CharPtr argv[])
{
   if (argc != 3)
      then printf("\nUsage: perfstk <min> <max>\n");
      else
         {
            measure_time();
            union REGS regs;
            regs.x.ax = 21;                  // trashes
existing mouse driver
            int86(0x33,  &regs,  &regs);           // if
present

            byte constatbyte=readcontstat(); //dummy
            constatbyte=readcontstat();
            delayms(40L);
            writecontstat(constatbyte & 0xdd);  //was dd
```

```
                int min = atoi(argv[1]);
                int max = atoi(argv[2]);
//                max -= min;
//                min = 0;
                StartMidiator(min, max);
            }
}
```

What is claimed:

1. A process for retrofitting an electronic musical instrument for supporting multiple parameter control, the process comprising the steps of:

(1) equipping the electronic musical instrument with at least one pointing stick, the or each pointing stick dedicated to a preselected information parameter and being adapted for sensing a force indicative of a desired control parameter; wherein the or each pointing stick is substantially immovable with respect to the instrument but can respond to finger-tip inputs;

and (2) connecting the or each immovable pointing stick to a musical instrument digital interface (MIDI) generator means for translating a force into a corresponding musical instrument digital interface instruction.

2. A retrofitted electronic musical instrument suitable for supporting multiple parameter control, the instrument comprising:

(1) at least one pointing stick, the or each pointing stick dedicated to a preselected information parameter and being adapted for sensing a force indicative of a desired control parameter; wherein the or each pointing stick is substantially immovable with respect to the instrument but can respond to finger-tip inputs;

and (2) a musical instrument digital interface (MIDI) generator means for translating said force into a corresponding musical instrument digital interface instruction.

3. An instrument according to claim 2, wherein the pointing stick comprises means for converting a force into a voltage equivalent of a graduated-scale MIDI command.

4. An instrument according to claim 2, wherein the pointing stick comprises a steel rod of 2 mm diameter and 2 cm length.

5. An instrument according to claim 2, wherein the pointing stick comprises:

(1) a cantilever structure attached to the musical instrument;

and (2) a sensor attached to the cantilever structure.

6. An instrument according to claim 5, wherein the sensor comprises a piezo-electric device.

* * * * *